US005146054A

United States Patent [19]

Etters

[11] Patent Number: 5,146,054

[45] Date of Patent: Sep. 8, 1992

[54] MOTION TRANSLATION MECHANISM FOR A VEHICLE SEAT SWITCH

[75] Inventor: Harry N. Etters, Downers Grove, Ill.

[73] Assignee: Illinois Tool Work Inc., Glenview, Ill.

[21] Appl. No.: 754,680

[22] Filed: Sep. 4, 1991

[51] Int. Cl.[5] ..... H01H 3/02

[52] U.S. Cl. ..... 200/85 A

[58] Field of Search ..... 200/85 R, 85 A, 342, 200/406, 535

[56] References Cited

U.S. PATENT DOCUMENTS

| | | | |
|---|---|---|---|
| 2,399,867 | 5/1946 | Hetherington | 200/406 |
| 2,420,880 | 5/1947 | Hetherington | 200/535 |
| 3,288,963 | 11/1966 | Mondy | 200/406 |
| 3,670,119 | 6/1972 | Gebhardt et al. | 200/52 R |
| 3,921,750 | 11/1975 | Shames | 200/406 X |
| 4,678,058 | 7/1987 | Wooters | 180/273 |

*Primary Examiner*—J. R. Scott

*Attorney, Agent, or Firm*—T. W. Buckman; D. J. Breh

[57] ABSTRACT

A motion translation mechanism is adapted for use in a vehicle seat-operated switch and is selectively responsive to the presence or absence of a downward vertical force. The motion translation mechanism includes a switch assembly having a plunger, a leaf spring, and coil spring. The coil spring is used to resiliently bias a first end portion of the leaf spring against a first stop. The second end portion of the leaf spring is operatively connected between a second stop and the plunger for moving laterally the plunger to a retracted position in response to the downward movement of an upwardly convexed central portion of the leaf spring so as to electrically actuate the switch assembly.

20 Claims, 2 Drawing Sheets

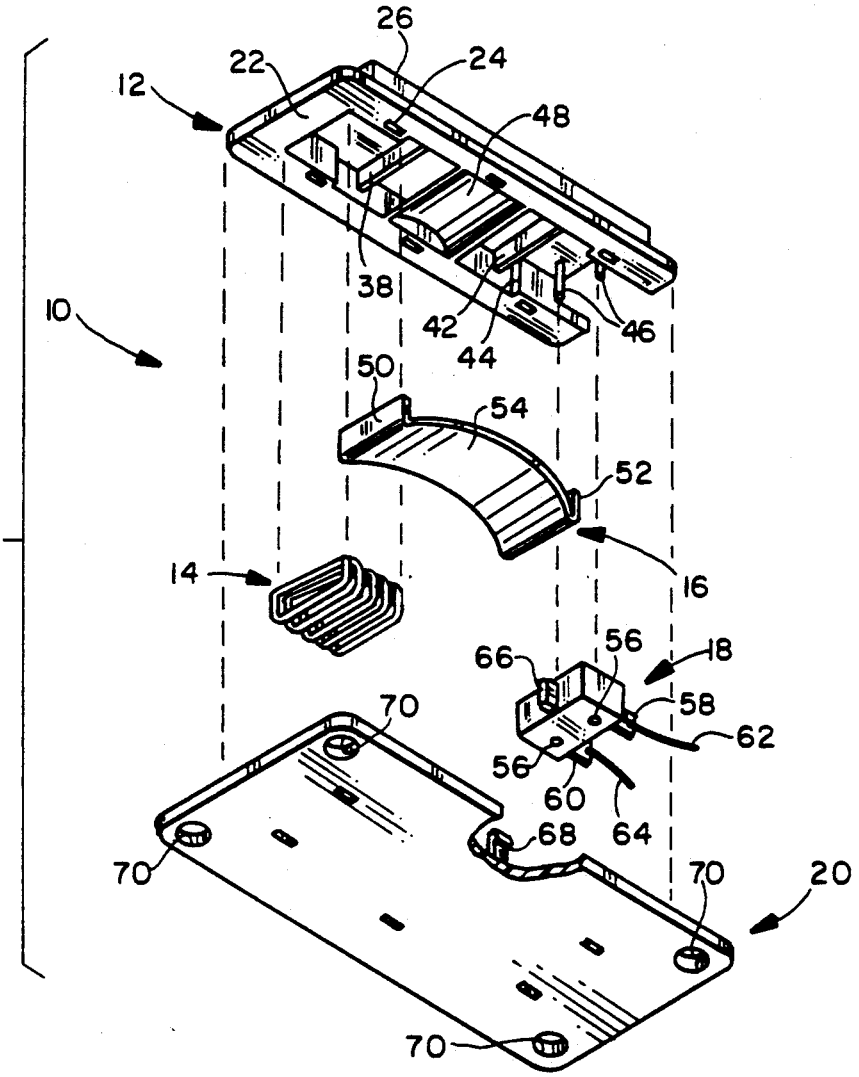
FIG. 1
FIG. 2
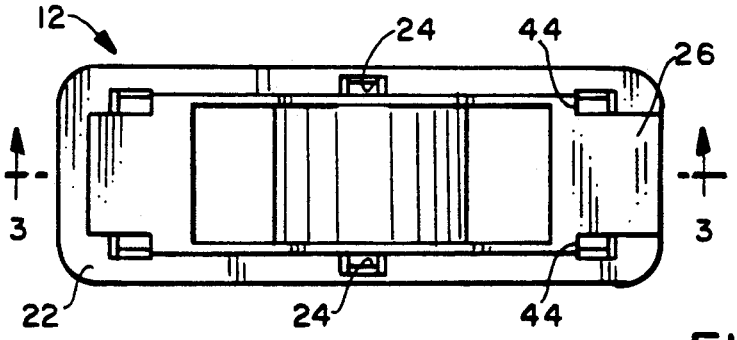
FIG. 3
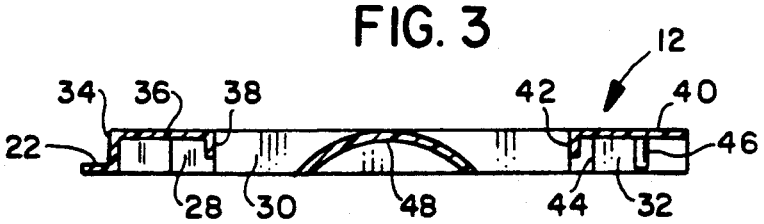

MOTION TRANSLATION MECHANISM FOR A VEHICLE SEAT SWITCH

BACKGROUND OF THE INVENTION

1. Field of the Invention

This invention relates generally to seat-operated switches and more particularly, it relates to a motion translation mechanism adapted for use in a vehicular seat-operated switch.

2. Description of the Prior Art

A prior art search directed to the subject matter of this application was conducted in the U.S. Patent and Trademark Office and revealed the following U.S. Letters Patent:

U.S. Pat. No. 2,399,867
U.S. Pat. No. 2,420,880
U.S. Pat. No. 3,288,963
U.S. Pat. No. 3,670,119
U.S. Pat. No. 4,678,058

In U.S. Pat. No. 2,399,867 to Robert Hetherington issued on May 7, 1946, there is disclosed a snap switch which includes a snap disc 31 having rearwardly directed arms 43, 44 at its side edges. The disc is normally convexed forwardly. An operating push button plunger is used to bend or reverse the convexity of the disc so as to present it convexly toward the rear. As a result, this switch is operated and the pads 45 formed on the arms will become engaged with the fixed contacts 41, 42 (FIG. 2) or will break engagement with the fixed contacts 41', 42' (FIG. 2*a*). When the plunger is released, the resetting spring 51 presses the disc forwardly, thereby convexing the disc forwardly to its original position.

In U.S. Pat. No. 2,420,880 to Robert Hetherington issued on May 20, 1947, there is disclosed a snap switch which is quite similar to the '867 patent and includes a snap disc 39 that is normally convexed forwardly at 39, (FIG. 4). The disc is held in place beneath the cap 37 and against the ends of an insulation bridge 40. The bridge is forwardly concaved at 46 so as to give support at its diametrical ends 47 to the disc. The concavity permits the disc to convex rearwardly in which the arms 51, 52 attached to the edges of the disc are permitted to move with these edges but to be free to spring at the bend 53. The pads 56, 57 on the arms will then make contact with the fixed contact strips (FIG. 2) or will break contact with the fixed strips 31', 32' (FIG. 2*a*).

In U.S. Pat. No. 4,678,058 to Eldon W. Wooters issued on Jul. 7, 1987, there is taught a vehicular seat switch which includes a generally C-shaped spring located underneath the seat cushion. This spring is comprised of inner and outer vertical shank portions connected by a generally horizontal arcuate central portion. The inner shank portion is secured to the seat switch and the outer shank portion is connected to an actuating rod of the switch. When weight is placed on the seat, the central portion of the spring is flattened so as to displace laterally the shank portions. The lateral displacement of the shank portions will cause the actuating rod to move outwardly, thereby closing the switch contacts to permit vehicle operation.

However, none of the prior art patents discloses a motion translation mechanism having a leaf spring like that of the present invention in which the first end portion of the leaf spring is resiliently biased by a compression spring and the second end portion of the leaf spring contacts a plunger of the switch assembly for providing actuation thereof.

SUMMARY OF THE INVENTION

Accordingly, it is a general object of the present invention to provide a motion translation mechanism adapted for use in a vehicle seat-operated switch which is relatively simple and economical to manufacture and assemble.

It is an object of the present invention to provide a motion translation mechanism adapted for use in a vehicle seat-operated switch which is compact, sturdy, reliable and is formed of a relatively few number of component parts.

It is another object of the present invention to provide a motion translation mechanism which includes a leaf spring having a first end portion resiliently biased by a coil spring and a second end portion engaging a plunger of a switch assembly, the central portion of the leaf spring being vertically movable so as to cause the plunger to move laterally to actuate the switch assembly.

In accordance with these aims and objectives, the present invention is concerned with the provision of a motion translation mechanism which is selectively responsive to the presence and absence of a downward vertical force. The motion translation mechanism includes a switch assembly having a plunger which is movable laterally between extended and retracted positions for electrically closing and opening the switch assembly. A leaf spring includes a first end portion, a second end portion, and an upwardly convexed central portion. The first end portion is connected to the second end portion by the upwardly convexed central portion. The upwardly convexed central portion is vertically moveable in response to the movement of the vertical force.

A mounting bracket is provided with first and second stops for engaging the respective first and second end portions of the leaf spring. A coil spring is provided for resiliently biasing the first end portion of the leaf spring against the first stop. The second end portion of the leaf spring is operatively connected between the second stop and the plunger for moving laterally the plunger to the retracted position in response to the downward movement of the outwardly convexed central portion so as to electrically close or open the switch assembly.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 1 is an exploded view of a motion translation mechanism, constructed in accordance with the principles of the present invention;

FIG. 2 is a top plan view of the mounting bracket in FIG. 1;

FIG. 3 is a cross-sectional view, taken along the lines 3—3 of FIG. 2;

DESCRIPTION OF THE PREFERRED EMBODIMENT

Figure 5:
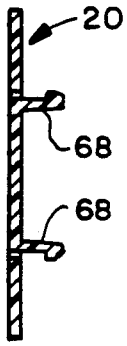
FIG. 5 is a cross-sectional view, taken along the lines 5—5 of FIG. 4.
Figure 4:
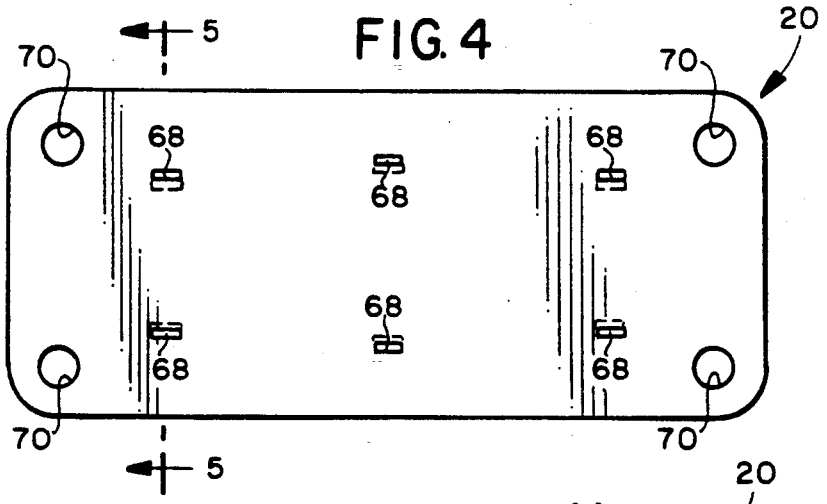
FIG. 4 is a top plan view of the mounting plate of FIG. 1.

Referring now in detail to the various views of the drawings, there is shown in FIGS. 1 through 5 a motion translation mechanism 10 of the present invention adapted for use in a vehicle seat-operated switch. The motion translation mechanism 10 is comprised of a mounting bracket 12, a rectangular compression spring 14, a leaf spring 16, a switch assembly 18, and a mounting plate 20.

The mounting bracket 12 is formed generally of a rectangular construction and is made of any suitable material such as thermoplastic or the like, which may be formed by an injection molding process. The mounting bracket includes an outer flange portion 22 having a plurality of openings or recesses 24 and an inner body 26. The body portion 26 has a left-end compartment 28, a central compartment 30, and a right-end compartment 32.

The left-end compartment 28 is formed by a vertical wall 34, a horizontal wall 36, and a first downwardly extending flange 38. The right-end compartment 32 is formed by a horizontal wall 40, a second downwardly extending flange 42, and a pair of shoulder portions 44. The shoulder portions 44 are provided in the outer flange portion 22. The horizontal wall 40 of the compartment 32 includes a pair of downwardly extending mounting posts 46. The central compartment 30 is defined by the first and second downwardly extending flanges 38 and 42. The central compartment 3 further includes in its intermediate section a vertical arcuate-shaped member 48.

The rectangular compression spring 14 is preferably a coil spring made of a metal such as stainless steel. The compression spring 14 is disposed within the left-end compartment 28 of the mounting bracket 12 with the ends of the spring being adjacent the vertical wall 34 and the first downwardly extending flange 38. The leaf spring 16 is comprised of outwardly extending end portions 50, 52 connected by an upwardly convexed central portion 54. The leaf spring is retained in the central compartment 30 of the mounting bracket with its end portions 50, 52 being engaged with the first and second downwardly extending flanges 38 and 42 so that the convexed central portion 54 overlies and is in spaced-apart relationship to the arcuate-shaped member 48. The leaf spring may be formed of any suitable resilient material such as stainless steel.

The switch assembly 18 may be of any commercially available type similar to Type 16-402 manufactured and sold by Illinois Tool Works, Inc. The switch assembly 18 includes a housing having a pair of apertures 56 extending therethrough. The switch assembly 18 also includes in its rear portion fixed terminal contacts 58, 60 connected to a pair of respective electrical leads or wires 62, 64 which are connectible to an electrical circuitry of a vehicle system. The switch assembly 18 further includes in its front portion a plunger 66 which is movable laterally in response to a force applied thereto for placing the switch in either its open or closed position, dependent upon the position of the plunger 66 in the extended position shown in FIG. 7 or in the retracted position illustrated in FIG. 8.

It will be understood that the fixed terminal contacts 58 and 60 may be either normally opened or normally closed. In the preferred embodiment of the present invention, the electrical circuitry of the vehicle system is connected in series by the leads 62 and 64 to the motion translation mechanism 10 and is operative in response to the switch assembly 18 being electrically closed in the retracted position and is inoperative in response to the switch assembly 18 being electrically open which occurs when the plunger 66 is in the extended position.

Figure 6:
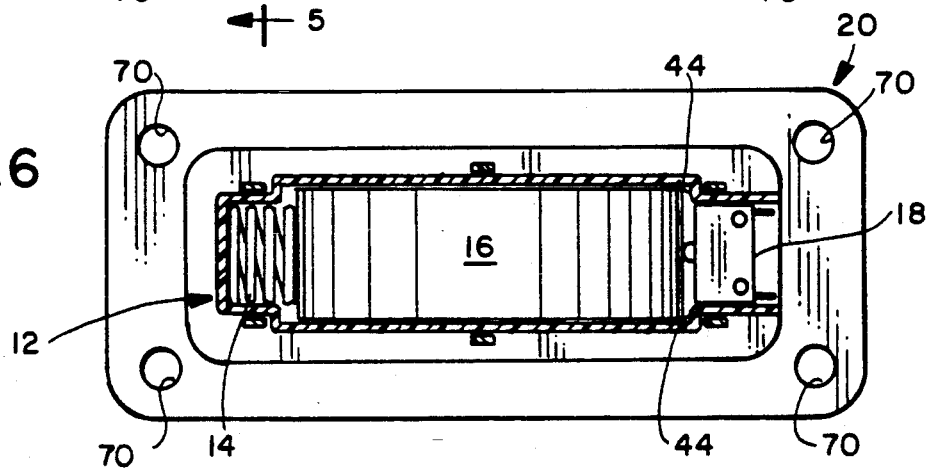
FIG. 6 is a top plan view of the motion translation mechanism of FIG. 1 in its fully assembled condition, with portions of the mounting bracket being omitted for clarity.
Figure 7:
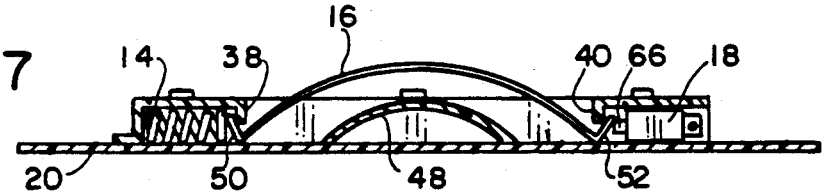
FIG. 7 is a cross-sectional view of the motion translation mechanism in its fully assembled condition.

The mounting plate 20 is also generally formed of a rectangular construction and is also made of any suitable material, such as thermoplastic and the like, which may be formed by an injection molding process. The mounting plate includes a plurality of vertical hooked-shape projections 68 which are receivable into the corresponding recesses 24 of the mounting bracket 12 so as to form the fully assembled motion translation mechanism 10 as illustrated in FIGS. 6 and 7. The mounting plate 20 further includes a plurality of mounting holes 70 which permits the assembled motion translation mechanism to be secured or mounted to a seat support plate (not shown) of a vehicular operator's seat by conventional mounting means. In such use, the convexed central portion 54 of a leaf spring 16 will engage the underside of a seat cushion (not shown) and will respond to a downward vertical deflection of the cushion.

The operation of the motion translation mechanism 10 of the present invention adapted for use in the seat switch will now be explained with reference to FIGS. 7 through 9. In FIG. 7, the motion translation mechanism is in its normal or inactivated position in which the end portions 50, 52 of the leaf spring 16 abuts or engages the outer surfaces of the flanges 38 and 40 defining first and second leaf spring stop means. In this position, the compression spring 14 resiliently biases the first end portion 50 of the leaf spring against the first stop means 38. Further, the second end portion 52 of the leaf spring is sandwiched between the second stop means 40 and the extended position of the switch plunger 66.

Figure 8:
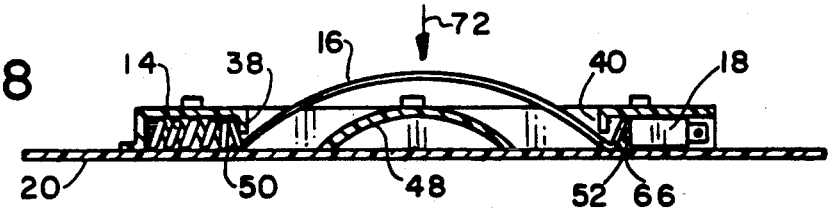
FIG. 8 is a cross-sectional view similar to FIG. 7, except the leaf spring is partially flattened.

When the seat cushion is depressed as caused by the operator sitting in the seat, the convexed central portion 54 of the leaf spring 16 will be moved downwardly in the direction of the arrow 72 illustrated in FIG. 8. This downward vertical movement will reduce or partially flatten the arch of the convexed central portion and will cause the end portion 52 of the leaf spring to move laterally (towards the right). As a result, the plunger 66 is retracted to the position shown in FIG. 8 and the switch assembly 18 is actuated or closed. It will be noted that the end portion 52 will continue to move laterally until it engages with the shoulder portions 44 defining third leaf spring stop means. The rectangular compression spring 14 is initially strong enough to prevent compression thereof and thus does not permit the end portion 50 of the leaf spring to move laterally (towards the left).

Figure 9:
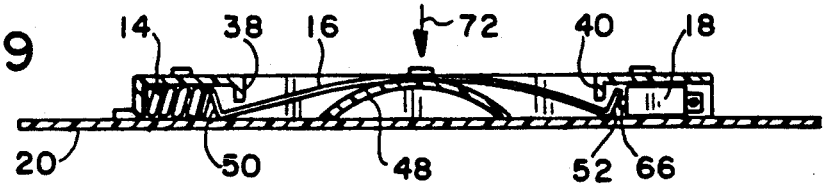
FIG. 9 is a cross-sectional view similar to FIG. 8, except the leaf spring is fully flattened.

However, as the force is continued in the direction of the arrow 72 in FIG. 8, the end portion 50 of the leaf spring will overcome the force of the compression spring 14 and will move laterally the latter (towards the left) as illustrated in FIG. 9. This subsequent downward movement and further flattening of the arch after the plunger has been retracted is referred to sometimes as "over travel." The amount of over travel is limited by the convexed central portion 54 coming into contact with the arcuate-shaped member 48 defining a fourth stop means in the central compartment 30 of the mounting bracket 12.

Upon the operator removing his weight from the seat, the seat cushion will return to its original undeflected position, causing the convexed central portion 54 of the leaf spring to return to its normal position as shown in FIG. 7. As a result, the plunger 66 is allowed to return to its extended position, thereby placing the switch assembly 18 in the electrically open position.

From the foregoing detailed description, it can thus be seen that the present invention provides a motion translation mechanism adapted for use in a vehicular seat-operated switch. The motion translation mechanism is formed of a switch assembly having a plunger, a leaf spring, and a coil spring. The coil spring resiliently biases the first end portion of the leaf spring. The second end portion of the leaf spring is engagable with the plunger for actuation of the switch assembly.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. In a motion translation mechanism which is selectively responsive to the presence and absence of a downward vertical force, said mechanism comprising:

a switch assembly having a plunger which is movable laterally between extended and retracted positions for electrically closing an opening said switch assembly;

a leaf spring having a first end portion, a second end portion, and an upwardly convexed central portion, said first end portion being connected to said second end portion by said upwardly convexed central portion, said upwardly convexed central portion being vertically movable in response to the movement of the vertical force;

a mounting bracket having first and second stop means for engaging said respective first and second end portions of said leaf spring;

a coil spring for resiliently biasing said first end portion of said leaf spring against said first stop means; and said second end portion of said leaf spring being operatively connected between said second stop means and said plunger for moving laterally said plunger to the retracted position in response to the downward movement of said upwardly convexed central portion so as to electrically close or open said switch assembly.

2. In a motion translation mechanism as claimed in claim 1, wherein said mounting bracket further includes third stop means for limiting the lateral movement of said second end portion of said leaf spring away from said second stop means.

3. In a motion translation mechanism as claimed in claim 2, wherein said coil spring prevents compression thereof during movement of said second end portion of said leaf spring from said second stop means to said third stop means.

4. In a motion translation mechanism as claimed in claim 3, wherein said mounting bracket further includes fourth stop means for limiting the continued downward vertical movement of said central portion of said leaf spring.

5. In a motion translation mechanism as claimed in claim 4, wherein said fourth stop means is comprised of a vertical arcuate-shaped member for engagement with the central portion of said leaf spring when it is flattened during the continued downward vertical movement.

6. In a motion translation mechanism as claimed in claim 5, wherein said first end portion of said leaf spring is subsequently moved laterally and away from said first stop means so as to compress said coil spring when said central portion of said leaf spring is being flattened during the continued downward vertical movement.

7. In a motion translation mechanism which is selectively responsive to the presence and absence of a downward vertical force, said mechanism comprising:

switch means having a plunger which is movable laterally between extended and retracted positions for electrically closing and opening said switch means;

leaf spring means having a first end portion, a second end portion, and an upwardly convexed central portion, said first end portion being connected to said second end portion by said upwardly convexed central portion, said upwardly convexed central portion being vertically movable in response to the movement of the vertical force;

first stop means for engaging said first end portion of said leaf spring means;

second stop means for engaging said second end portion of said leaf spring means;

compression spring means for resiliently biasing said first end portion of said leaf spring means against said first stop means; and said second end portion of said leaf spring means being operatively connected between said second stop means and said plunger for moving laterally said plunger to the retracted position in response to the downward movement of said upwardly convexed central portion so as to electrically close or open said switch means.

8. In a motion translation mechanism as claimed in claim 7, further comprising third stop means for limiting the lateral movement of said second end portion of said leaf spring means away from said second stop means.

9. In a motion translation mechanism as claimed in claim 8, wherein said compression spring means prevents compression thereof during movement of said second end portion of said leaf spring means from said second stop means to said third stop means.

10. In a motion translation mechanism as claimed in claim 9, further comprising fourth stop means for limiting the continued downward vertical movement of said central portion of said leaf spring means.

11. In a motion translation mechanism as claimed in claim 10, Wherein said fourth stop means is comprised of a vertical arcuate-shaped member for engagement with the central portion of said leaf spring means when it is flattened during the continued downward vertical movement.

12. In a motion translation mechanism as claimed in claim 11, wherein said first end portion of said leaf spring means is subsequently moved laterally and away from said first stop means so as to compress said compression spring means when said central portion of said leaf spring means is being flattened during the continued downward vertical movement.

13. In a motion translation mechanism which is selectively responsive to the presence and absence of a downward vertical force, said mechanism comprising:

a mounting bracket having a first end compartment, a central compartment, and a second end compartment;

a switch assembly mounted in said second end compartment and having a plunger which is movable laterally between extended and retracted positions for electrically closing and opening said switch assembly;

a leaf spring mounted in said central compartment and having a first end portion, a second end portion, and an upwardly convexed central portion, said first end portion being connected to said second end portion by said upwardly convexed central portion, said upwardly convexed central portion being vertically movable in response to the movement of the vertical force;

said mounting bracket having first and second stop means for engaging said respective first and second end portions of said leaf spring;

a coil spring mounted in said first end compartment for resiliently biasing said first end portion of said leaf spring against said first stop means;

said second end portion of said leaf spring being operatively connected between said second stop means and said plunger for moving laterally said plunger to the retracted position in response to the downward movement of said upwardly convexed central portion so as to electrically close or open said switch assembly; and a mounting plate being joined to said mounting bracket for housing said switch assembly, leaf spring, and coil spring therebetween.

14. In a motion translation mechanism as claimed in claim 13, further comprising mounting means formed on said mounting bracket and said mounting plate for securing the same together.

15. In a motion translation mechanism as claimed in claim 14, wherein said mounting bracket is made of a thermoplastic material.

16. In a motion translation mechanism as claimed in claim 15, wherein said mounting plate is made of thermoplastic material.

17. In a motion translation mechanism as claimed in claim 16, wherein said leaf spring is made of a stainless steel.

18. In a motion translation mechanism as claimed in claim 17, wherein said coil spring is made of a stainless steel.

19. In a motion translation mechanism as claimed in claim 13, wherein said mounting bracket further includes third stop means for limiting the lateral movement of said second end portion of said leaf spring away from said second stop means.

20. In a motion translation mechanism as claimed in claim 19, wherein said mounting bracket further includes fourth stop means for limiting the continued downward vertical movement of said central portion of said leaf spring.

* * * * *